United States Patent [19]

Reick

[11] 4,284,519

[45] Aug. 18, 1981

[54] HALOCARBON OIL COMPOSITION

[75] Inventor: Franklin G. Reick, Westwood, N.J.

[73] Assignee: Michael Ebert, Mamaroneck, N.Y.; a part interest

[21] Appl. No.: 168,317

[22] Filed: Jul. 10, 1980

Related U.S. Application Data

[63] Continuation-in-part of Ser. No. 158,329, Jun. 10, 1980.

[51] Int. Cl.[3] ..... C10M 3/24; C10M 3/20; C10M 3/02

[52] U.S. Cl. ..... 252/16; 252/29; 252/54.6; 252/58; 252/75; 252/78.1

[58] Field of Search ..... 252/16, 29, 54.6, 58, 252/75, 78.1

[56] References Cited

U.S. PATENT DOCUMENTS

| | | | |
|---|---|---|---|
| 3,412,140 | 11/1968 | Seil et al. | 252/54.6 |
| 3,730,894 | 5/1973 | Heilweil et al. | 252/16 |
| 3,933,659 | 1/1976 | Lyle et al. | 252/75 |
| 3,956,154 | 5/1976 | Marolewski et al. | 252/78.1 |
| 4,203,856 | 5/1980 | Pardee | 252/54.6 |
| 4,213,870 | 7/1980 | Loran | 252/54.6 |

*Primary Examiner*—Delbert E. Gantz
*Assistant Examiner*—Irving Vaughn
*Attorney, Agent, or Firm*—Michael Ebert

[57] ABSTRACT

A halocarbon oil composition suitable for use as a hydraulic fluid and lubricant in those applications in which hydrocarbon oils constitute a fire hazard or a contaminant because of their reactive properties. The composition is formed by a chemically-inert halocarbon oil having PTFE solid lubricant particles dispersed therein, the particles being in the micron range. Also included is a fluorochemical surfactant having foam-producing properties in an amount insufficient to generate foam in the context of the inherent non-foaming characteristics of the particles, the surfactant acting to enhance the lubricity of the oil and to stabilize the PTFE dispersion therein.

6 Claims, No Drawings

HALOCARBON OIL COMPOSITION

RELATED APPLICATION

This application is a continuation-in-part of my copending application Ser. No. 158,329, filed June 10, 1980, entitled "Stabilized Hybrid Lubricant."

BACKGROUND OF INVENTION

This invention relates generally to halocarbon oil compositions, and more particularly to a composition suitable for use as a hydraulic fluid and lubricant in those applications in which hydrocarbon oils constitute a fire hazard or a reactive contaminant.

In modern aircraft, the hydraulic installation is largely made up of pumping equipment for supplying hydraulic fluid under pressure, a network of pipelines for distributing the pressurized hydraulic fluid, and cylinders, hydraulic motors and other devices operated by the hydraulic fluid. The hydraulic working fluid is usually mineral oil which also acts as a lubricant for the moving parts of the system.

The use of mineral oils in hydraulic aircraft systems gives rise to a serious fire hazard, especially in connection with the undercarriage or retractable landing gear mechanism of the aircraft. In the event the aircraft is forced to make a crash landing causing the belly of the craft to skid along the ground, sparks will be generated by this action; and should this landing, as is often the case, also result in the rupture of hydraulic lines causing hydraulic fluid to spurt out and be ignited by the sparks, a fire will result with highly destructive consequences.

The designers and operators of aircraft are well aware of this problem and have sought to find effective substitutes for mineral oil as a hydraulic fluid. One approach heretofore taken has been to use a solution of glycol in water as an aircraft hydraulic fluid. While a glycol composition of this type cannot be ignited by sparks, it leaves much to be desired; for it is somewhat corrosive to hydraulic parts and has inferior lubricating properties.

The reactive properties of hydrocarbon lubricating oils is also a drawback in other applications. Thus when mechanisms used in the production and processing of microelectronic components are lubricated by hydrocarbon oil, even a slight leakage of this oil may cause a contaminating reaction with the components being worked on.

SUMMARY OF INVENTION

In view of the foregoing, the main object of this invention is to provide a halocarbon composition which is non-reactive and non-contaminating, and which is capable of acting effectively as a hydraulic fluid and lubricant in those applications where the use of mineral and other hydrocarbon oils creates a fire hazard or other serious problems.

A significant feature of a halocarbon oil composition in accordance with the invention resides in the inclusion therein of a dispersion of PTFE micropowders which affords boundary layer lubrication and results in a marked reduction in friction between moving parts that make contact with each other. Also, these particles act to plug capillary leaks in hydraulic systems, thereby contributing an additional safety factor.

Briefly stated, these objects are attained in a chemically-inert halocarbon oil composition suitable as a hydraulic fluid and lubricant, the composition being formed by a dispersion in the oil of PTFE solid lubricant particles in the micron range, which dispersion is stabilized by a fluorochemical surfactant having foam-producing properties in an amount insufficient to generate foam in the context of the inherent defoaming properties of the particles, which are preferably of high angularity.

The surfactant not only inhibits agglomeration and settling out of the particles but also enhances the lubricity of the halocarbon oil so that the halocarbon oil composition has hydraulic fluid and lubrication properties comparable to those of a hydrocarbon oil product without the drawbacks thereof.

DETAILED DESCRIPTION OF INVENTION

The basic ingredient of a composition in accordance with the invention is a halocarbon oil such as #10-24 oil produced by Halocarbon Products Corporation of Hackensack, New Jersey. Halocarbon oils are saturated, hydrogen-free chlorofluorocarbons that are chemically inert and have high thermal stability as well as high density and non-polar characteristics. These are made by controlled polymerization techniques and then stabilized so that the terminal groups are completely halogenated and inert.

The ability of halocarbon oils to withstand high temperature and the inertness of this oil makes this oil highly suitable as a hydraulic fluid, but for the fact that a standard halocarbon oil has lubricating characteristics distinctly inferior to mineral oil.

In order to enhance the lubricating characteristics of the halocarbon oil without otherwise degrading its useful properties, added thereto is a small amount of PTFE particles in the micron range, with an average particle size preferably no greater than about 5 microns. PTFE (polytetrafluoroethylene) is a solid lubricant having an extremely low coefficient of friction. When dispersed as a microfine powder in the oil, the PTFE material affords boundary layer lubrication, the oil serving to distribute the powders in the regions of contact between moving parts.

A preferred commercially-available type of non-aqueous PTFE particles is the "Polymist" marketed by Allied Chemical Corporation, these powders being in the micron range. The reason "Polymist" is preferred is that these PTFE particles are in highly angular shapes rather than round, the sharpness of the particles augmenting their inherent defoaming characteristics. The preferred ratio of PTFE particles to the oil by weight is about one part to one thousand, but this ratio is not critical. To stabilize the dispersion, use is made of a small but effective amount of a fluorochemical surfactant solution that is characterized by an ability to produce stable foams in low polarity hydrocarbon liquids such as kerosene, xylene and crude oils. A preferred agent for this purpose is "Fluorad" FC-740, a Well Stimulation Additive manufactured by the Commercial Chemical Division of the 3M Company at St. Paul, Minnesota. As described in the "Product Information" bulletin published in 1980 by the 3M Company, FC-740 is a solution of a nonionic fluorochemical surfactant belonging to the chemical class of fluorinated alkyl esters. It is the most effective member of that class with regard to its ability to foam low polarity hydrocarbon liquids. It also acts as a foaming agent when used with a halocarbon oil, but such foaming must be suppressed when the oil is used as a hydraulid fluid where the presence of a compressible gas or foam is highly undesirable.

Inasmuch as a foaming action would result in an undesirable oil-air froth, one must also be careful to avoid foaming in the context of lubrication. At first blush, therefore, the inclusion of a surfactant having foam-generating characteristics would appear to be interdicted. However, it has been discovered that a fluorochemical surfactant solution having foam-generating characteristics will not give rise to foaming when used in a small but effective amount in the context of a halocarbon oil composition having a PTFE dispersion therein in accordance with the invention, the surfactant then acting to significantly improve the stability of the dispersion and to enhance the overall lubricity of the composition.

A surface active agent or surfactant is a compound that reduces interfacial tension between two liquids or between a liquid and a solid. Interface refers to the area of contact between two immiscible phases of a dispersion. At a fresh surface of either liquid or solid, the molecular attraction exerts a net inward pull. Hence the characteristic property of a liquid is surface tension, while that of a solid surface is adsorption. Both phenomena have the same cause; that is, the inward cohesive forces acting on the molecules at the surface. The wettability of solid particles such as PTFE is intimately associated with interfacial behavior.

A foam is a tightly packed aggregation of gas bubbles separated from each other by thin films of liquid. The properties of a liquid would not lead one to expect that thin films are capable of sustaining themselves for any appreciable amount of time against the effect of gravity. However, the existence and stability of a foam depend on a surface layer of solute molecules which form a structure quite different from that of the underlying film within the interbubble film.

On the other hand, defoaming agents act to inhibit the formation of foam or to destroy foam which has been formed. Defoaming agents may operate via a number of mechanisms, the most common being those of entry and/or spreading. One well-known defoaming agent which functions to repress foaming activity is a dispersion in hydrocarbon oil of fine particles of silica coated with silicone, the silicone surface rendering the particles hydrophobic. The defoaming action of this formulation is explainable on the basis of the entry mechanism. Because PTFE particles are hydrophobic, they are also capable of functioning as a defoaming agent, but they are not as effective as silicone-coated silica particles. Hence where a foaming agent is present in relatively large quantities in an oil medium having PTFE particles dispersed therein, these particles may not then succeed in defoaming the medium.

In the context of a halocarbon lubricant having a dispersion of PTFE particles therein in accordance with the invention, the inclusion of a nonionic fluorochemical surfactant solution having foam-generating characteristics, though serving to bring about a reduction in interfacial tension which acts to enhance the long-term stability of the dispersion, nevertheless does not give rise to undesirable foaming activity when the amount of surfactant employed for this purpose is relatively small, such as one part per weight to 1,000 parts of oil.

It is essential that the PTFE particles remain thoroughly dispersed in the oil and that they do not cluster and settle out. In a hydraulic system, the dispersed PTFE particles are circulated by the oil throughout the entire system; and where minute capillary leaks exist, the particles tend to lodge therein to plug the leaks. In a high-pressure hydraulic system, this plugging action represents a significant advantage.

While there has been shown and described a preferred embodiment of halocarbon oil composition in accordance with the invention, it will be appreciated that many changes and modifications may be made therein without, however, departing from the essential spirit thereof.

I claim:

1. A non-reactive halocarbon oil composition suitable for use as a hydraulic fluid and as a lubricant, the composition including a dispersion in the oil of solid lubricant particles having inherent defoaming characteristics, the particles being in the micron size range, and a fluorochemical surfactant possessing foam-generating characteristics in an amount insufficient to generate foam but sufficient to stabilize the dispersion and enhance the lubricity of the oil, said surfactant is a nonionic surfactant belonging to the chemical class of fluorinated alkyl esters.

2. A composition as set forth in claim 1, wherein said particles are PTFE.

3. A composition as set forth in claim 1, wherein said particles are graphite.

4. A composition as set forth in claim 1, wherein the average particle size is no greater than about 5 microns.

5. A composition as set forth in claim 1, wherein said particles are angular in shape.

6. A composition as set forth in claim 1, wherein said particles by weight are about one part to 1,000 parts of oil.

* * * * *